US006494553B1

(12) United States Patent
Donahue et al.

(10) Patent No.: US 6,494,553 B1
(45) Date of Patent: Dec. 17, 2002

(54) INK LEVEL SENSING FOR INK PRINTER

(75) Inventors: Frederick A. Donahue, Walworth, NY (US); Richard E. Butts, Rochester, NY (US); Ronald C. Macera, Palmyra, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/878,490

(22) Filed: Jun. 11, 2001

(51) Int. Cl.[7] ..... B41J 2/195
(52) U.S. Cl. ..... 347/7
(58) Field of Search ..... 347/7, 14, 19, 347/23

(56) References Cited

U.S. PATENT DOCUMENTS 5,132,711 A * 7/1992 Shinada et al. ..... 347/7
5,414,452 A 5/1995 Accatino et al. ..... 347/7
5,712,667 A * 1/1998 Sato ..... 347/7
5,798,771 A * 8/1998 Nishii et al. ..... 347/7
5,997,121 A 12/1999 Altfather et al. ..... 347/7
6,024,429 A * 2/2000 Coffy et al. ..... 347/7
6,048,045 A * 4/2000 Nohata et al. ..... 347/7
6,151,039 A * 11/2000 Hmelar et al. ..... 347/7

* cited by examiner

*Primary Examiner*—John Barlow
*Assistant Examiner*—Blaise Mouttet
(74) *Attorney, Agent, or Firm*—David J. Arthur

(57) ABSTRACT

An ink jet printer that includes a printhead for ejecting ink droplets, an ink container for supplying ink to the printhead, and an ink level sensor for measuring the level of ink in the ink container, includes an ink level sensor activator. The ink level sensor activator causes the ink level sensor to measure the level of ink in the ink container after the printhead has ejected a predetermined quantity of ink. The ink level sensor activator records the quantity of ink ejected by the printhead onto the print medium by measuring to the number of droplets of ink ejected, and/or by determining the number of pixels in an image to be printed for which ink is to be ejected. If the quantity of ink ejected has a predetermined threshold, the ink level sensor measures the quantity of ink in the ink container.

13 Claims, 6 Drawing Sheets

INK LEVEL SENSING FOR INK PRINTER

BACKGROUND

The present invention relates to ink printers that deposit ink images onto a print medium, and in particular relates to managing the quantity of ink remaining in an ink container for such a printer.

Many types of ink printers eject ink onto a print medium, such as paper, in controlled patterns of closely spaced dots. To form color images, multiple groupings of ink jets are used, with each group being supplied with ink of a different color from an associated ink container. Ink printers use different techniques to eject ink from a printhead onto the print medium. Ink printing techniques use mechanism such as thermal, acoustic, piezo-electric, or other types of energy to eject ink droplets that form the dots on the print medium, creating the printed image.

Thermal ink jet printers use thermal energy to vaporize momentarily ink in an ink channel nozzle and form bubbles on demand. Resistors located in capillary filled ink channels near a channel terminating nozzle or orifice generate the thermal energy to vaporize the ink into bubbles in the channel. Each temporary bubble expels an ink droplet from the nozzles, and propels the ink droplet from the printhead toward the recording medium. The printing system may be incorporated in either a carriage type printer or a page width type printer. A carriage type printer generally has a relatively small printhead containing the ink channels and nozzles. The printhead is attached to an ink supply container, which is typically carried on the same carriage as the printhead. The carriage with the printhead and container is reciprocated across a print region to print one swath of information at a time on a recording medium that is held stationary on a platen. After the swath is printed, the medium is stepped a distance equal to the height to the printed swath, so that the next printed swath will be contiguous with the previous printed swath. The procedure is repeated until the entire page is printed. In contrast, the page width printer has a stationary printhead having a length equal to or greater than the width of the recording or print medium. The print medium is continually moved at a constant speed past the page width printhead in a direction normal to the printhead length.

Attempting to eject ink drops when no ink is available at the printhead may damage the printhead. Therefore, printing should stop before the ink container is empty. When an ink printer and the user of such an ink printer are aware of the quantity of ink remaining in a particular ink container, the printer can reduce the possibility of attempting to print after the ink container is empty.

U.S. Pat. No. 5,997,121 describes a system and method that detects a low level of ink in an ink container, and provides a low ink level warning signal. The system and method described there determine when the level of ink in an ink container has fallen below a particular threshold. Once the printer detects a low ink level in the ink container, the printer can manage ink usage, and reduce the possibility of continuing to attempt to print using that ink container after the supply in the container has been exhausted. The ink level detecting takes place in a maintenance station, which typically is outside the normal printing range of the carriage. Thus, detecting the ink level in the container requires that the carriage carrying the printhead and ink container be moved out of the printing range. This movement takes time, and thus may slow certain print jobs. Therefore, printers balance frequent measurements of the ink level, to maintain an accurate measure of the quantity of ink remaining in the ink container, with delays introduced into the printing process caused by the measurement process.

Many printers perform an ink level detection at the end of each print job, when the cartridge carriage is typically moved into the maintenance station for other maintenance purposes, such as cleaning the printhead. During lengthy printing jobs, such as multi-page printing jobs, some printers direct the printhead carriage into the maintenance station to perform ink level sensing at intervals based on the number of pages printed. For example, the printer may perform an ink level measurement after a predetermined number of pages, such as after each page. However, determining the appropriate number of pages between successive measurements of the ink level tends to produce inexact results, as different print jobs may apply significantly different amounts of ink to each page, and even within a single print job, different pages may have significantly different quantities of ink applied to them.

SUMMARY

An ink printer includes a printhead for depositing ink onto a print medium, an ink container connected to the printhead for supplying ink to the printhead, and an ink level sensor for measuring the level of ink in the ink container. An ink level sensor activator measures the approximate quantity of ink deposited by the printhead, and periodically causes the ink level sensor to measure the level of ink in the ink container after the printhead has deposited a predetermined quantity of ink.

In an ink printer having a printhead, an ink container connected to the printhead for supplying ink to the printhead, and an ink level sensor for measuring the quantity of ink in the ink container, a method of determining when the ink level sensor should measure the quantity of ink in the ink container includes measuring the quantity of ink ejected by the printhead, periodically determining if the quantity of ink ejected by the printhead has succeeded a predetermined threshold, and, if the quantity of ink ejected by the printhead has exceeded the predetermined threshold, measuring the quantity of ink in the ink container.

DETAILED DESCRIPTION

Figure 1:
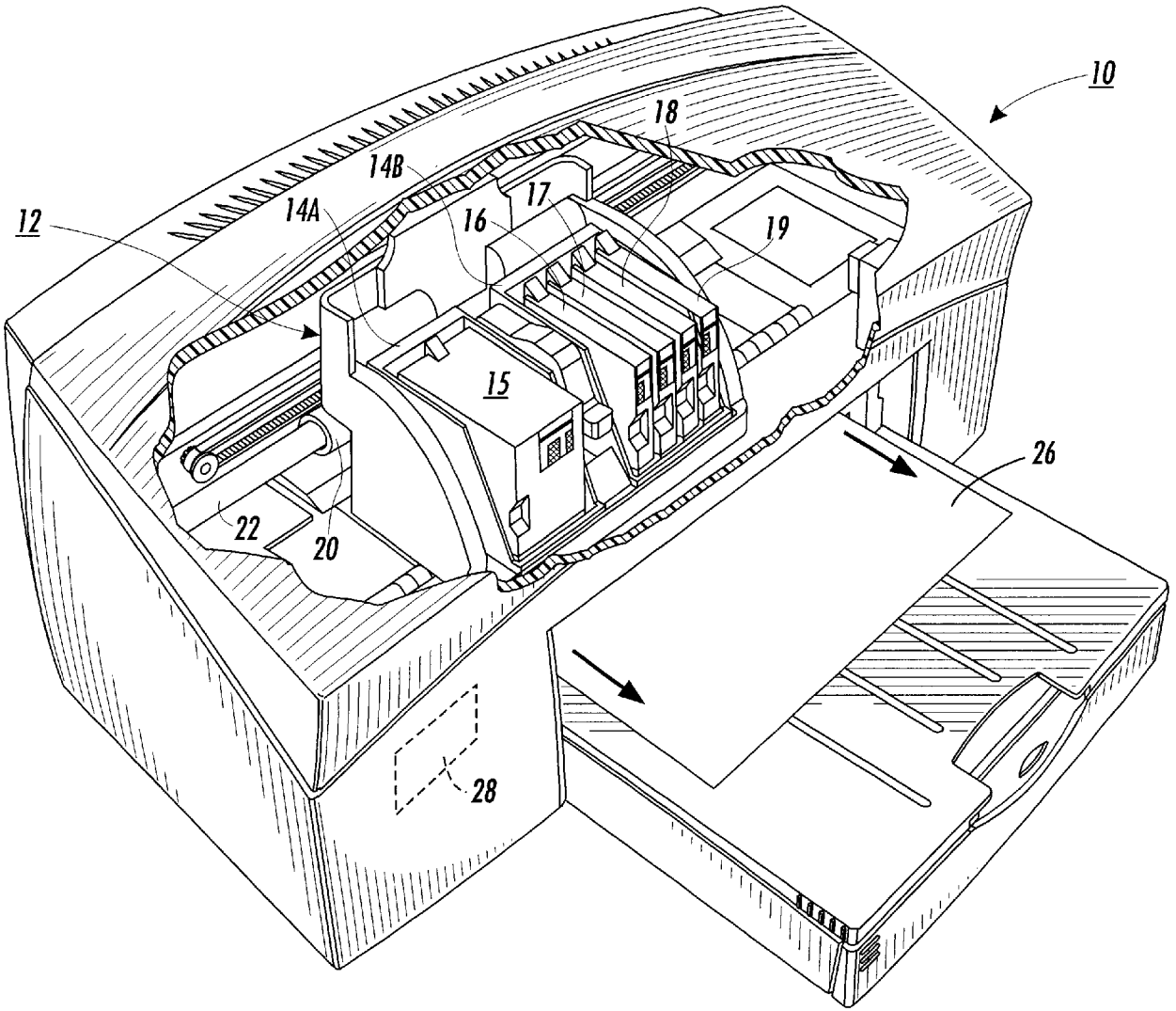
FIG. 1 is a perspective view of an exemplary ink printer incorporating an aspect of the present invention.

Referring to FIG. 1, an ink printer 10 includes an ink supply system 12 that incorporates a printhead cartridge assembly 14 with several printheads 24 (see FIGS. 2, 3, and 4) and ink containers 15, 16, 17, 18, 19. The printhead cartridge assembly is mounted on a carriage 20 that reciprocates along a carriage rail 22 that is attached to the frame of the printer. The illustrated embodiment includes five ink containers 15, 16, 17, 18, 19 in a cartridge support structure 14 to form the printhead cartridge assembly. A relatively larger ink container 15 containing black ink (the "black container") is mounted in one cartridge support structure, while four relatively smaller containers of color ink 16, 17, 18, 19 are mounted in a second cartridge support structure. The color containers typically contain cyan, magenta, and yellow ink, and "photo black" ink. However, the system described can be used in multi-color printers with any number of ink containers, or in monochrome printers with only one ink container or with multiple ink containers.

In the particular embodiment illustrated, the printheads 24 are permanently affixed to the ink cartridge support structure 14. During a printing operation, the carriage 20 with the cartridge support structure 14, including the printheads 24 and ink containers 15, 16, 17, 18, 19 reciprocates back and forth along the carriage rail. A media support, such as a platen (not shown), is attached to the printer frame for supporting the print medium 26 (such as paper) in a print position adjacent the path of the printheads as the carriage reciprocates along the carriage rails. As the carriage 20 moves across the print medium in the print range of movement, a printer system controller 28 directs each printhead to expel appropriate droplets of ink from selected ones of the nozzles in each printhead toward the medium that is supported by the platen.

When the printer is idle, or not printing, or when the ink level in the ink containers is to be measured, the carriage 20 is moved to one side of the printer, such as to the right side of the printer as shown in FIG. 1, outside the print range, and beyond the edge of the print medium. The printer may include at this position a maintenance station. The maintenance station includes devices for cleaning the printheads 24, measuring the ink level in the ink containers 15, 16, 17, 18, 19, and performing certain other maintenance tasks.

Figure 2:
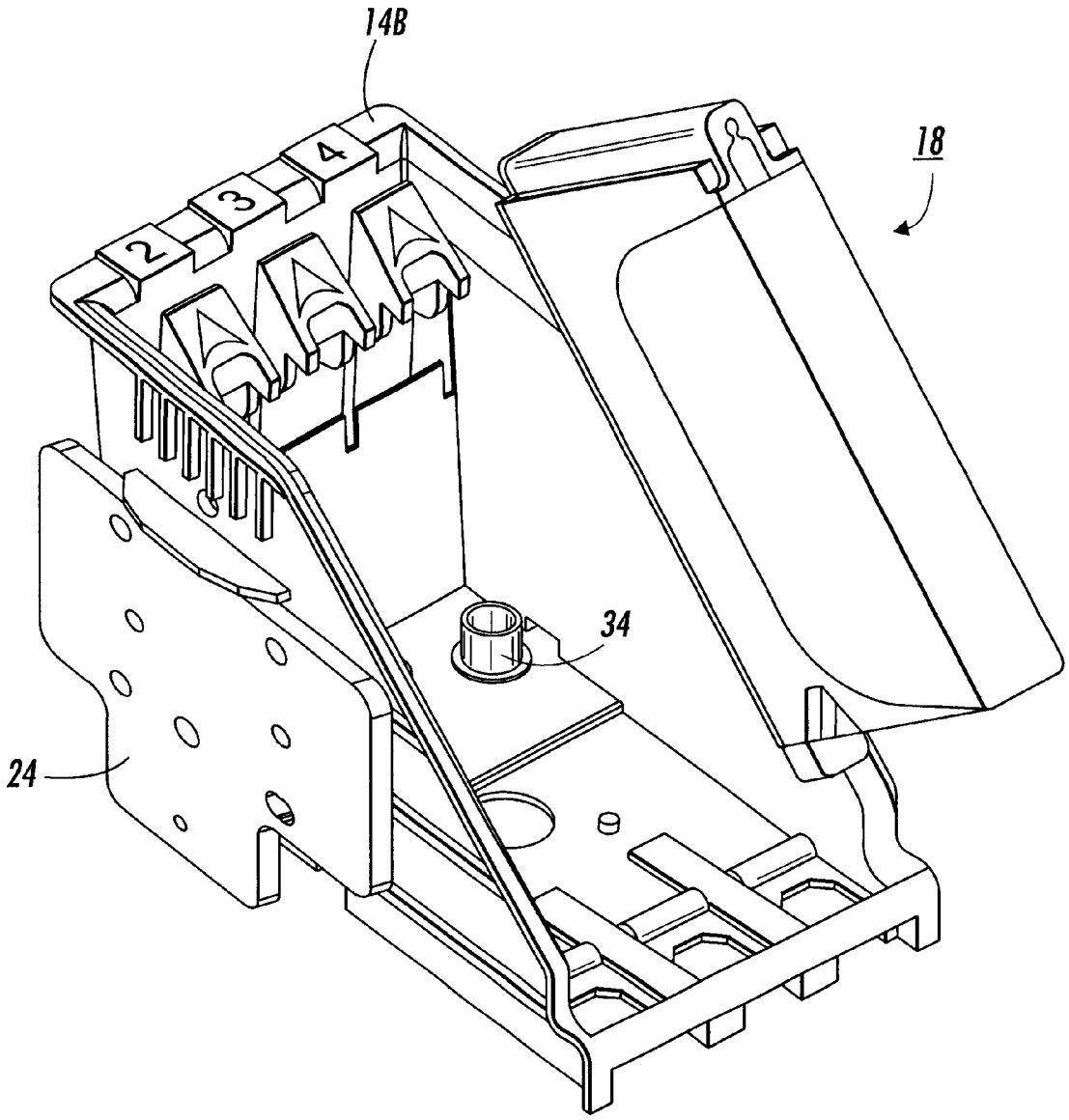
FIG. 2 is a perspective view of an exemplary ink cartridge support structure and an associated ink cartridge in the process of installation.
Figure 3:
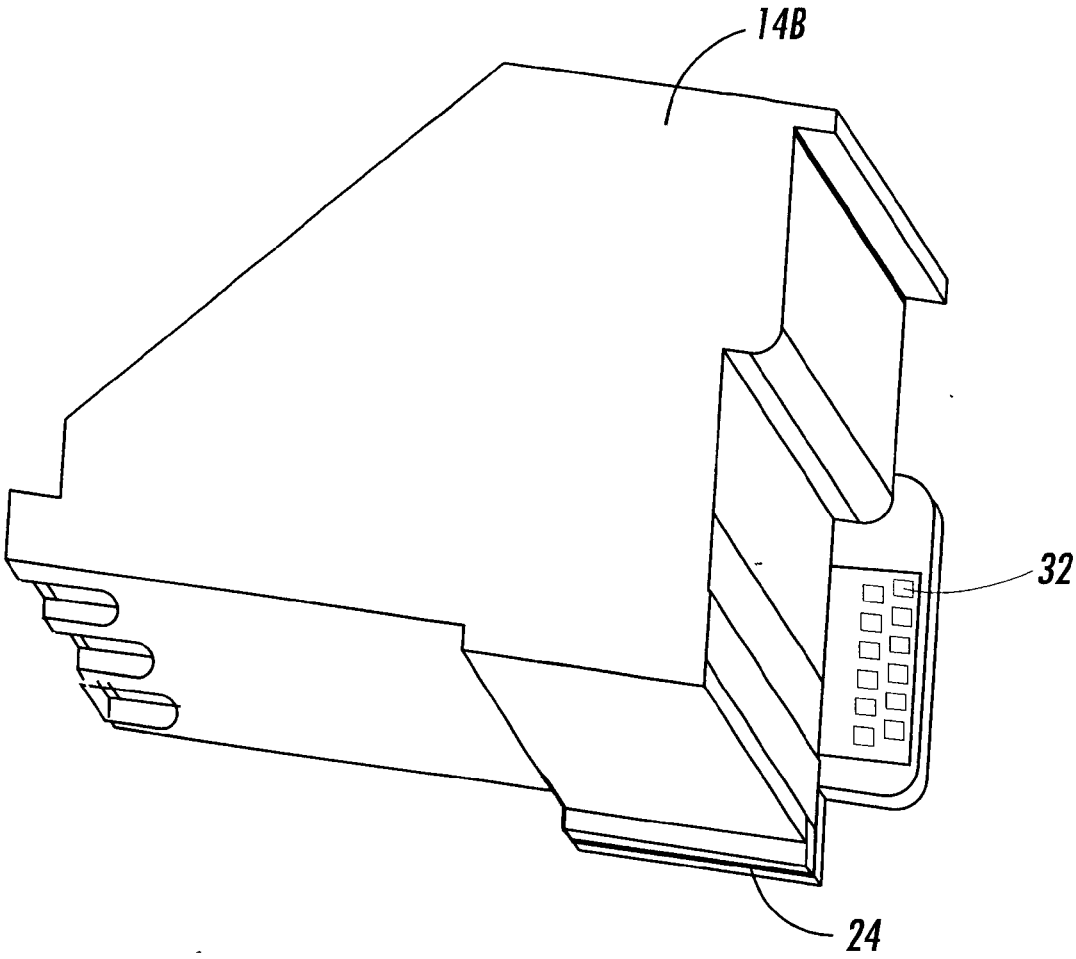
FIG. 3 is a different perspective view of the ink cartridge support mechanism shown in FIG. 2.
Figure 4:
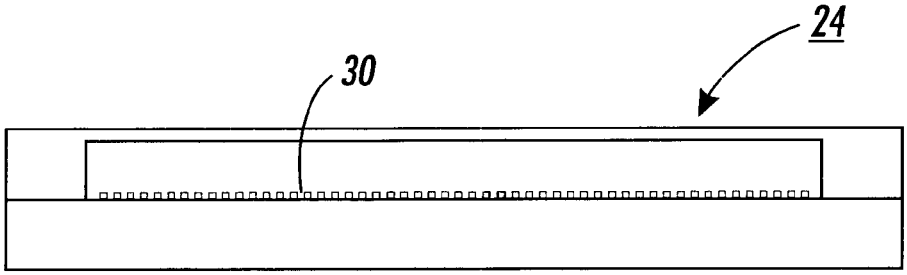
FIG. 4 is a view of the printhead attached to the ink cartridge support mechanism of FIGS. 2 and 3.

A representative ink cartridge support structure for multiple color ink containers is shown in FIGS. 2, 3, and 4. The particular version of the multiple tank support structure 14b shown in FIG. 2 holds three color ink tanks, rather than the four tank version shown in the printer of FIG. 1. Referring to FIG. 2, the ink cartridge support structure 14*b* has mounted on one side thereof the printhead 24. Referring to the views of FIGS. 3 and 4, the printhead comprises a plurality of ink nozzles 30 arranged in a pattern at the end of the printhead. In a particular embodiment illustrated, the nozzles 30 are arranged in a linear fashion. Other patterns of nozzles may be used, including multiple parallel rows of nozzles offset or staggered sets of nozzles, and so forth. Ejecting the appropriate ink droplet at the appropriate time is governed by electrical signals supplied to the printhead from the printer through electrical contacts 32 on the printhead.

Referring again to FIG. 2, the printhead draws ink from an ink supply container through a manifold and capillary tubes in the printhead and the support structure (not shown). The support structure includes a manifold mounting pipe 34 that connects with an outlet port 36 (see FIG. 5) of a replaceable ink container 16 to supply ink from the replaceable ink container to the printhead 24. The manifold and capillary tubes in the multiple tank support structure 14 *b* direct ink from each separate ink container to a different segment of the printhead. Thus, the nozzles of different segments of the printhead of the multiple container support structure are each associated with a particular one of the ink containers 16, 17, 18, 19. Although an embodiment is illustrated in which the ink containers are separate from the printheads, the principles described herein can also be applied to printer configurations in which the printhead is integrally formed with the replaceable ink container, so that both are replaced simultaneously. Multiple ink containers can also be integrally attached to a single printhead.

Figure 5:
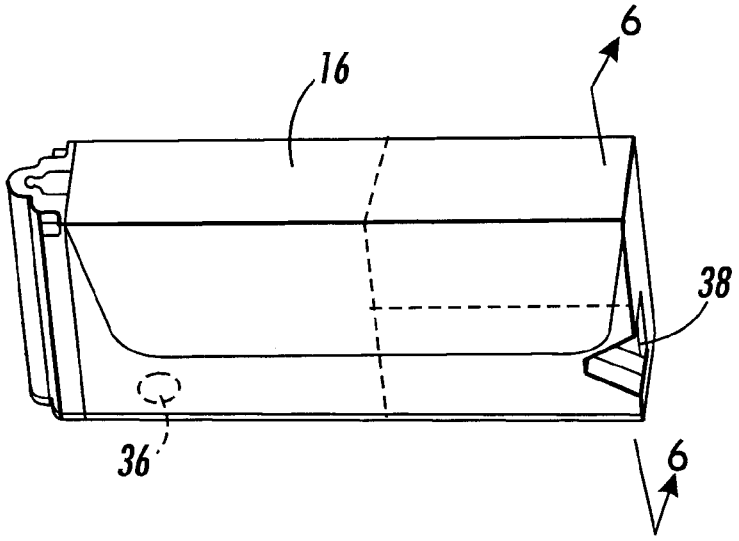
FIG. 5 is a perspective view of an ink container for installation in the print cartridge support structure of FIGS. 2 and 3.
Figure 6:
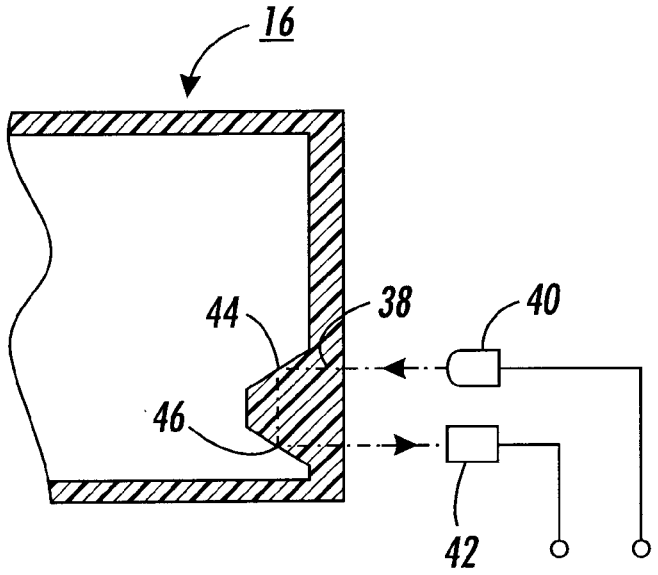
FIG. 6 is a schematic view of an ink level sensing mechanism of the printer of FIG. 1 for detecting the level of ink in an ink container of FIG. 5.

The printer user may want to know when the level of ink in the replaceable ink container 15, 16, 17, 18, 19 is low, so that the user can replace the ink container before the ink container runs completely dry. Also, if the printer controller 28 is notified when the ink in the replaceable ink container is nearly exhausted, the printer controller 28 can stop the printing operation before the ink container runs completely dry. Operating the printhead when there is no ink in the printhead channels may damage certain components of the printhead. Different printers have different mechanisms for determining when the level of ink remaining in the replaceable ink container is low. Typically, these mechanisms measure the quantity of ink in the container when the printhead carriage moves into the maintenance station, which is typically to one side of the printer. One such ink level measurement mechanism is an optical ink level measurement system, such as is described in U.S. Pat. No. 5,997,121 to Altfather et al., the contents of which are hereby incorporated by reference. This exemplary optical ink level sensing or measurement technique takes advantage of the total internal reflection of light in a prism that is dependent on the difference in the index of refraction between the material forming the housing of the replaceable ink container, and air or ink in the interior of the ink container. Referring now to FIGS. 5 and 6, the ink container housing includes a prism 38 formed of the housing material, which is a light transmissive material, such as transparent or translucent plastic. The prism 38 projects into the interior of the ink container. Referring to FIG. 6, the ink level sensor of the printer includes a light source 40 and an optical detector 42. When the ink container 16 is adjacent the ink level sensor, the light source 40 is activated to direct light toward the prism 38. If the ink level in the ink tank is sufficient to cover the prism, light directed from the light source through the prism is transmitted on into the ink, and the optical detector 42 receives little or no reflected light. If, however, the ink level is below the top prism surface 44, the light from the light source is internally reflected in the prism 38 of the plastic material forming the housing toward the lower prism surface 46. If the lower prism surface 46 is also not immersed in ink, the light is again reflected, to travel toward the optical detector 42. The printer controller 28 is connected to receive signals from the optical detector 42. The printer controller 28 interprets the output signal from the optical detector 42 when light is reflected to the optical detector as indicating that the level of ink in the container is low. Those familiar with ink printing mechanisms will recognize that other mechanisms for measuring the level of ink in the ink container can be used. For example, a light emitting diode sensor reflected from a flexible membrane that serves as the upper surface of an ink supply reservoir may be used, as can a pair of electrodes immersed in the ink, and other techniques.

Once the printer controller 28 determines that the ink level in the ink container is low, the printer manages that information in accordance with its pre-programmed instructions. For example, the printer may stop printing immediately, or it may print a predetermined amount recognizing that once the ink level sensor determines that the level of ink in the ink container is low, the amount of ink remaining in the container is known.

As noted above, optical ink level measurement typically is performed in the maintenance station at the side of the printer, which requires that the printer move the carriage to the maintenance station. Many printers move the carriage to the maintenance station between print jobs. However, during longer print jobs, moving the carriage to the maintenance station takes time that may slow a print job.

To reduce the number of times during a long print job that the printer moves the print carriage 20 to the maintenance station to perform optical ink level measurement, the printer controller measures and retains a record of the ink ejected by each portion of the printhead associated with each of the ink containers 15, 16, 17, 18, 19. Because the nozzles of different segments of the printhead of the multiple container support structure are each associated with a particular one of the ink containers 16, 17, 18, 19 in the multiple container support structure 14*b,* the printer can record the number of droplets of ink ejected by the printhead for each individual ink container. The printer performs an optical ink level measurement at predetermined intervals as determined by the amount of ink ejected by the printhead 24. The printer controller 28 compares the amount of ink ejected by the printhead 24 since the immediately preceding ink level measurement, to determine if the quantity of ink ejected by the printhead from that particular ink container has exceeded a particular predetermined threshold. If the amount of ink ejected by the printhead since the immediately preceding ink level measurement has exceeded that threshold, the printer controller causes the carriage to move the carriage into the maintenance station so that the printer can perform an ink level measurement. If however, the ink ejected has not exceeded the threshold, the printer controller causes the printer to continue printing. In one particular implementation, the printer controller records the actual number of times that the resistors for each ink jet orifice are activated. Because each nozzle ejects a predetermined amount of ink each time that the resistor is activated, counting the number of times that the resistors are activated provides the controller with a measure of the quantity of ink ejected by the printhead. Alternatively, the printer controller can determine the quantity of ink ejected by the printhead by analyzing the data to be printed by the printer, and determining the number of pixels in that image that require a droplet of ink. The term "pixel count" is used in this description to refer to both methods of determining the quantity of ink ejected by the printhead.

Figure 7:
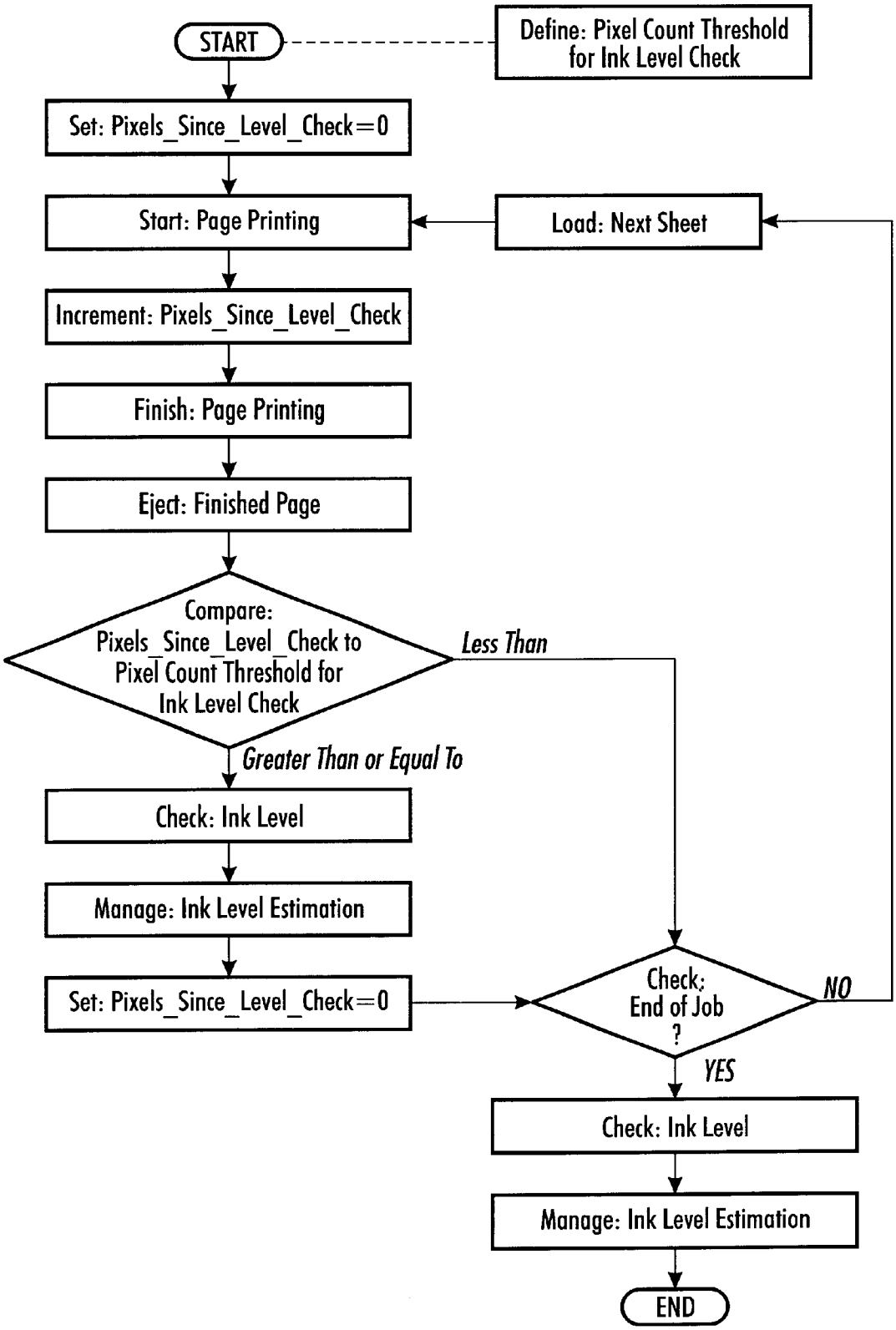
FIG. 7 is a flow diagram of a particular implementation of a method of sensing an ink level in an ink container in an ink printer.

Referring next to FIG. 7, the printer controller 28 sets a Pixel Count Threshold for ink level check, at or before the beginning of a print operation. This Pixel Count Threshold quantifies the number of ink droplets that approximately correspond to the maximum amount of ink that the printer is to eject from the ink container between successive measurements of the ink level in the ink container. At the start of a print job, the printer has performed an ink level check to determine the quantity of ink in the ink container, at least to the extent of determining whether the quantity of ink is above or below the level at which the printer identifies a low ink condition in the ink container. Thus, the printer controller sets the quantity of ink ejected since the immediately preceding ink level measurement (Pixels Since Level Check) at zero. The printer controller then causes the printer to start printing a page of the print job, and eject ink from the printhead onto the print medium in accordance with the print job instructions. The print job continues for a predetermined period. In the particular embodiment illustrated, the predetermined period is one page. The printer controller records the amount of ink used to print that page, and increments the Pixels Since Level Check counter by the number of pixels or drops of ink ejected in printing the page. The printer controller causes the printer to finish printing the page, and ejects the finished (printed) page from the printer. The printer controller compares the pixels printed (Pixels Since Level Check), which corresponds to the amount of ink ejected by the printhead during the printing of the page, with the preset Pixel Count Threshold for Ink Level Check. If the Pixels Since Level Check (the quantity of ink ejected by the printhead) is less than the Pixel Count Threshold for Ink Level Check, the printer determines whether it has reached the end of the printing job. If the printer has not reached the end of the job, the printer loads the next sheet of print medium, such as paper, into the printer, and begins printing another page. As the printer prints the page, the controller again increments the count of Pixels Since Level Check by the number of pixels printed (or ink droplets ejected) in printing the pate. Thus, the controller continues tracking the amount of ink ejected by the printer, adding to the amount recorded for the first page. After the second page is printed, the printer controller again compares the incremented Pixels Since Level Check (the ink ejected in printing both pages) with the Pixel Count Threshold for Ink Level Check. If the amount of ink ejected, as measured by the count of Pixels Since Level Check, remains less than the Pixel Count Threshold for Ink Level Check, the printer again checks for whether it has reached the end of the print job, and if not, prints yet another page. The printer can compare the quantity of ink ejected by the printhead with the pixel count threshold without moving the carriage out of the print range.

If, after printing any page, the amount of ink ejected, as measured by the Pixels Since Ink Level Check, is equal to or greater than the Pixel Count Threshold for Ink Level Check, the printer controller instructs the carriage to move into the maintenance station. There, the ink level sensor comprising the light source 40 and optical detector 42 can check the level of ink in the ink container. In the particular embodiment described, in which sensing the ink level consists of a simple determination of whether the level of ink in the container is above or below the low ink detection prism 38, the printer controller simply determines from that ink level sensing whether the ink in the ink container is nearly exhausted. The printer can then process the information in accordance with its programmed instructions to manage the estimated level of ink in the container.

The printer controller then sets the recording of the quantity of ink ejected since the immediately preceding ink level measurement (Pixels Since Level Check) to zero, to reflect that the ink level has been checked. The printer controller then again examines whether the print job is finished. If the ink level check determines that the ink container is not in a low ink condition, and the end of the print job has not been reached, the printer again loads another sheet of print medium, and continues the printing operation.

At any time, once the print job has ended, the printer controller may cause the print carriage 20 to move into the maintenance station, where the optical sensor determines whether the ink level in the container is above or below the optical prism.

Figure 8:
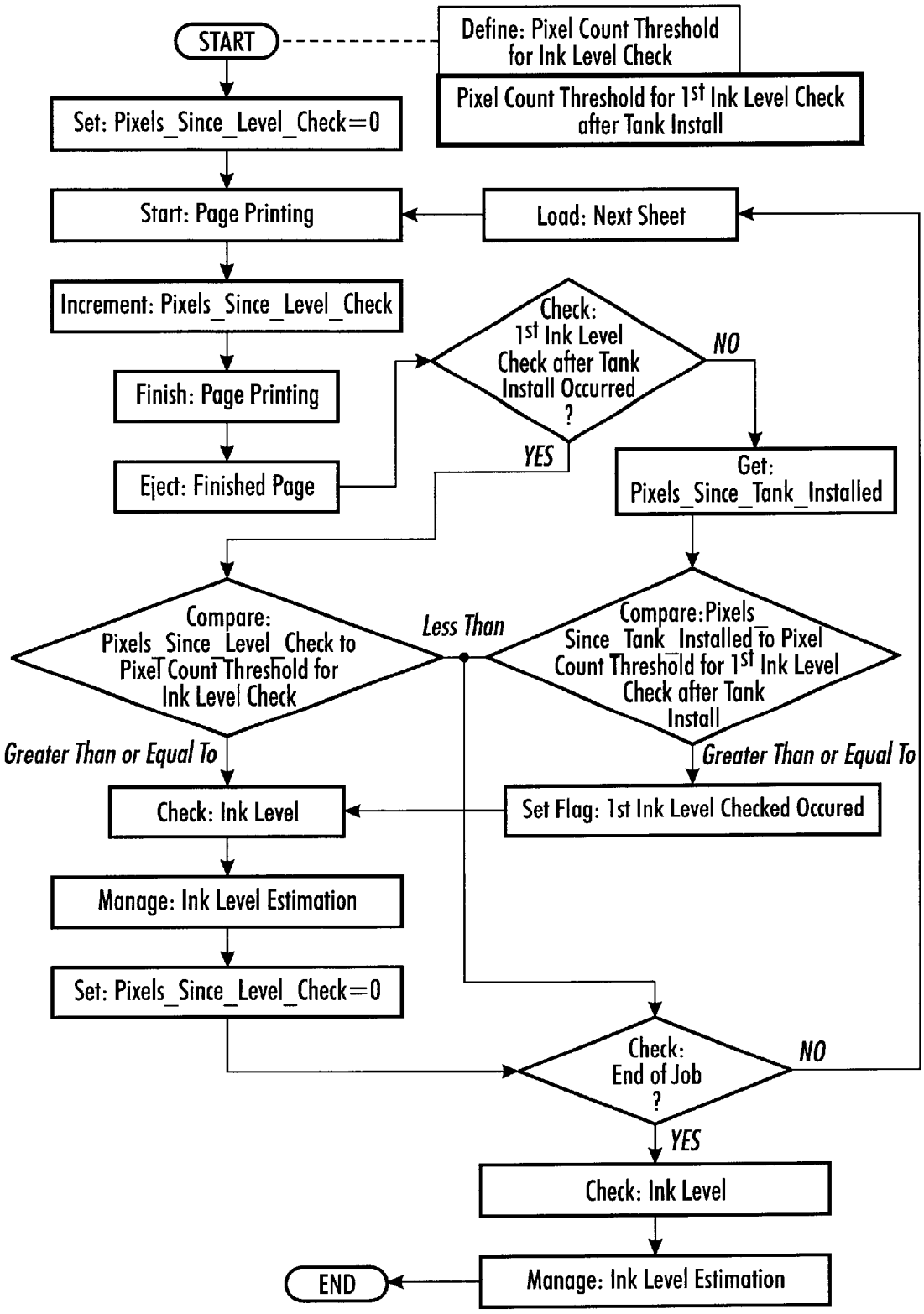
FIG. 8 is a flow diagram of an alternative implementation of a method of sensing ink level in an ink container in an ink printer.

Referring now to FIG. 8, The process shown and described in connection with FIG. 7 is again shown.

However, additional steps are provided to reduce the number of times that the printer controller causes the printer carriage to move into the maintenance station for ink level sensing when the print container is relatively new, and thus not expected to be in a low ink condition. Many printers include a mechanism to determine when the user has installed a new replaceable ink container. One simple mechanism is for the printer to conclude that if an ink level check identifies an ink container in a low ink condition, and a subsequent ink level check of that ink container establishes that the ink container is no longer in a low ink condition, a new ink container has probably been installed.

The printer may be programmed with information about the approximate quantity of ink contained in a new ink container. Thus, in accordance with the process illustrated in FIG. 8, a first ink level sensing threshold (Pixel Count Threshold for First Ink Level Check After Tank Install) represents the quantity of ink that the printer can expect to expel from the printhead before it is likely that the ink level check is likely to indicate that the ink level in the container is low. Using this first ink level check threshold, the printer with a relatively new print container can continue printing, without taking the time for periodic ink level checks. This saves the time that would otherwise be used by an ink level check during the early stages of use of a particular ink container, during which time the ink level check is not likely to indicate that the ink level in the ink container is low.

After printing a page, the printer controller checks whether the ink level of the ink tank has ever been checked. To do that, the printer controller checks whether a First Ink Level Check After Tank Install has occurred. If not, the controller retrieves the number of pixels ejected by the printhead since the printer controller determined that a new ink container (tank) was installed (the. Pixels Since Tank Installed). The printer controller compares the Pixels Since Tank Installed with the preset Pixel Count Threshold for First Ink Level Check After Tank Install. If the Pixels Since Tank Installed is less than the preset Pixel Count Threshold for First Ink Level Check After Tank Install, the printer controller concludes that it is not yet time to perform the first ink level check. The printer then proceeds with conventional printing operations by checking whether it has reached the end of the print job.

If, however, Pixels Since Tank Installed is less than the preset Pixel Count Threshold for First Ink Level Check After Tank Install, the printer controller concludes that it is time to perform the first ink level check. The printer controller sets a flag to provide future indication that the first ink level check has occurred. The printer controller then performs an ink level check. Thereafter, on subsequent completion of a predetermined amount of printing (such as a page), the printer controller inquires whether the first ink level check has been performed and is able to determine that the first ink level check has in fact been performed.

The present invention has been described in connection with particular implementations thereof. Those skilled in the art, after reading the above description, will recognize that various modifications, and alterations can be made to the particular implementations described above without departing from the spirit of the invention. For example, the intervals between determining whether to perform an ink level sensing measurement can be based at intervals other than each printed page, such as on a printed line basis, or per multiple pages, or per volume of data. In addition, different mechanisms for recording the amount of ink ejected by the printhead may be used. Furthermore, because in some printers, ink is ejected from the printhead during certain maintenance and cleaning operations, the printer controller may need to track such usage, either by actual count of such ejections, or by estimating. Furthermore, although the particular embodiments described above have been described in connection with their use on a thermal ink jet printer, those skilled in the art will recognize after reading the above description that the processes can also be applied to piezoelectric printers, acoustic ink jet printers, and other printers that apply ink to a print medium.

We claim:

1. In an ink printer having a printhead, an ink container connected to the printhead for supplying ink to the printhead, and an ink level sensor for measuring the quantity of ink in the ink container, a method of determining when the ink level sensor should measure the quantity of ink in the ink container, the method comprising:

measuring the quantity of ink ejected by the printhead;

periodically determining if the quantity of ink ejected by the printhead has exceeded a first predetermined threshold;

if the quantity of ink ejected by the printhead has exceeded the predetermined threshold, performing a first ink level measurement comprising measuring the quantity of ink in the ink container;

periodically after the first ink level measurement, determining if the quantity of ink ejected by the printhead since an immediately preceding ink level measurement has exceeded a second threshold; and if the quantity of ink ejected by the printhead since the immediately preceding ink level measurement has exceeded the second threshold, performing an additional ink level measurement comprising measuring the quantity of ink in the ink container.

2. The method of claim 1, wherein performing an ink level measurement comprises moving the printhead into a maintenance station.

3. The method of claim 2, wherein if the printhead is expected to eject additional ink, and if the quantity of ink ejected by the printhead since the immediately preceding ink level measurement has not exceeded the second threshold, the printhead is not moved into the maintenance station.

4. In an ink printer having a printhead, an ink container connected to the printhead for supplying ink to the printhead, and an ink level sensor for measuring the quantity of ink in the ink container, a method of determining when the ink level sensor should measure the quantity of ink in the ink container, the method comprising:

measuring the quantity of ink in the ink container with the ink level sensor while the ink container is installed in the printer;

during a printing operation, measuring the quantity of ink ejected by the printhead;

periodically during the printing operation, determining if the quantity of ink ejected by the printhead since the immediately preceding step of measuring the quantity of ink in the ink container has exceeded a predetermined threshold; and if the quantity of ink ejected by the printhead has exceeded the predetermined threshold, measuring the quantity of ink in the ink container with the ink level sensor while the ink container is installed in the printer.

5. The method of claim 4, wherein measuring the quantity of ink in the ink container comprises moving the printhead into a maintenance station in the printer.

6. The method of claim 5, wherein if the printhead is expected to eject additional ink, and if the quantity of ink ejected by the printhead since the immediately preceding ink level measurement has not exceeded a second threshold, the printhead is not moved into the maintenance station.

7. The method of claim 4, wherein periodically during the printing operation determining if the quantity of ink ejected by the printhead since the immediately preceding step of measuring the quantity of ink in the ink container has exceeded a predetermined threshold comprises, at the end of printing each page determining if the quantity of ink ejected by the printhead since the immediately preceding step of measuring the quantity of ink in the ink container has exceeded the predetermined threshold.

8. An ink printer, comprising:

a printhead for depositing ink onto a print medium;

an ink container connected to the printhead for supplying ink to the printhead;

an ink level sensor for measuring the level of ink in the ink container;

and an ink level sensor activator for measuring the approximate quantity of ink deposited by the printhead and causing the ink level sensor to measure during a printing operation the level of ink in the ink container only after the printhead has deposited a predetermined quantity of ink since a previous ink level measurement by the ink level sensor.

9. The ink printer of claim 8, wherein the sensor for measuring the level of ink in the ink container comprises a detector for detecting when the level of ink in the ink container is below a predetermined threshold.

10. The ink printer of claim 9, wherein the detector comprises an optical detector.

11. The ink printer of claim 8, wherein the ink level sensor activator causes the ink level sensor to measure the level of ink in the ink container during a printing operation only after the printhead has deposited the predetermined quantity of ink since the immediately preceding time that the ink level sensor measured the level of ink in the ink container.

12. The ink printer of claim 8, additionally comprising a maintenance station, wherein:

the ink level sensor is in the maintenance station; and the ink level sensor activator causes the printhead to move into the maintenance station to the ink level sensor during a printing operation only after the printhead has deposited the predetermined quantity of ink since the immediately preceding time that the ink level sensor measured the level of ink in the ink container.

13. The ink printer of claim 8, additionally comprising a maintenance station, wherein:

the ink level sensor is in the maintenance station; and the ink level sensor activator causes the printhead to move into the maintenance station to the ink level sensor during a multiple page printing operation only if the activator determines at the conclusion of printing each page that the printhead has deposited the predetermined quantity of ink since the immediately preceding time that the ink level sensor measured the level of ink in the ink container.

* * * * *